US010815093B1

(12) United States Patent
Yu

(10) Patent No.: US 10,815,093 B1
(45) Date of Patent: Oct. 27, 2020

(54) PROTECTIVE TAPE DISPENSER

(71) Applicant: Yang Bey Industrial Co., Ltd., Taichung (TW)

(72) Inventor: Teng-Chi Yu, Taichung (TW)

(73) Assignee: YANG BEY INDUSTRIAL CO., LTD., Taichung (TW)

( * ) Notice: Subject to any disclaimer, the term of this patent is extended or adjusted under 35 U.S.C. 154(b) by 0 days.

(21) Appl. No.: 16/777,875

(22) Filed: Jan. 30, 2020

(51) Int. Cl.
*B65H 35/00* (2006.01)

(52) U.S. Cl.
CPC ..... *B65H 35/0033* (2013.01); *B65H 35/0086* (2013.01); *B65H 2301/5154* (2013.01); *B65H 2701/377* (2013.01)

(58) Field of Classification Search
CPC ..... B65H 35/0033; B65H 35/004; B65H 2601/326; B65H 2701/32; B65H 37/04; B29C 62/024; B29C 62/02; C09J 7/02
See application file for complete search history.

(56) References Cited

U.S. PATENT DOCUMENTS 3,369,952 A * 2/1968 Rieger ..... B65C 11/004 156/577
3,539,418 A * 11/1970 Combs ..... B65H 35/0033 156/523
3,871,940 A * 3/1975 Antonioni ..... B05B 12/24 156/353
5,384,003 A * 1/1995 Mitchell ..... B65H 35/0033 156/510
5,549,255 A * 8/1996 Huang ..... B65H 35/0033 156/579
8,820,382 B1 * 9/2014 Renkert ..... B65H 35/0033 156/242
2008/0135179 A1 * 6/2008 Bedard ..... B65H 35/0033 156/510

* cited by examiner

*Primary Examiner* — Alex B Efta
(74) *Attorney, Agent, or Firm* — Bruce Stone LLP; Joseph A. Bruce

(57) ABSTRACT

A protective tape dispenser includes a mounting unit, a handle, a guide unit and a cutting unit. The guide unit has a tape pressing member and a turning member. The tape pressing member is located between the mounting unit and the turning member. The cutting unit includes an operation member and a fixing seat. One side of the fixing seat is provided with a blade holder. The tape pressing member and the turning member are configured to increase the tension of the protective tape and facilitate cutting. By pressing the operation member, the operation member drives a linking member to actuate the blade holder so as to extend or retract a blade, thereby increasing the smoothness of operation and achieving the purposes of labor-saving operation and easy force application.

9 Claims, 8 Drawing Sheets

PROTECTIVE TAPE DISPENSER

FIELD OF THE INVENTION

The present invention relates to a tape dispenser, and more particularly to a protective tape dispenser.

BACKGROUND OF THE INVENTION

A conventional tape applicator includes a handle, a blade holder and a tape roll seat above the handle. The blade holder is disposed in front of the tape roll seat. A roller is provided below the blade holder. A blade is insertedly connected to the blade holder. A protective tape roll is sleeved onto the tape roll seat. In use, one end of the protective tape of the protective tape roll is attached to a product to be sealed. Then, with the rotation of the protective tape roll, the protective tape is pulled to stretch an appropriate length. During the stretching process, the protective tape of the protective tape roll is attached to the surface of the product. Finally, the protective tape is cut by the blade, so that the packing process can be effectively simplified and the operation efficiency can be improved.

The above-mentioned tape dispenser is easy to operate for use. However, the protective tape is used for protecting an article and keeping the article from being damaged during carrying and transportation. Therefore, the protective tape needs a large force to be cut when in use. Besides, the protective tape cannot be aligned with the edge of the article when applying the protective tape, resulting in incomplete protection and being unsightly. Accordingly, the inventor of the present invention has devoted himself based on his many years of practical experiences to solve these problems.

SUMMARY OF THE INVENTION

The primary object of the present invention is to provide a protective tape dispenser, which can quickly attach the protective tape to the edge of a product, has the advantages of complete protection and increased aesthetics, and can increase the smoothness of operation, so as to achieve the purpose of labor-saving operation and easy force application.

In order to achieve the aforesaid object, the protective tape dispenser of the present invention comprises a base, a mounting unit, a handle, a guide unit, a cutting unit, a tape pressing unit. The base has an abutting portion at a bottom thereof. The base has a pivot member. The mounting unit is pivotally connected to the base. The mounting unit is configured to mount a protective tape roll. The handle is disposed on the base. The guide unit is disposed on the base. The guide unit includes a tape pressing member and a turning member. The tape pressing member is located between the mounting unit and the turning member. The cutting unit is disposed on the base. The cutting unit includes an operation member and a fixing seat. The operation member is pivotally connected to the pivot member. The operation member has a linking portion and a pressing portion that are located at two sides of the pivot member. A free end of the linking portion is connected to one end of an elastic member. Another end of the elastic member is fixed to the base. The fixing seat is fixed to the base. The fixing seat has a positioning member. The positioning member is connected with a blade holder. The blade holder is movable along the positioning member. The blade holder is provided with a blade. The tape pressing unit is pivotally connected to the abutting portion. The tape pressing unit has a first guide member and a second guide member.

When the protective tape dispenser provided by the present invention is in use, the protective tape of the protective tape roll is pulled out to pass around the outer side of the turning member along the inner side of the tape pressing member, and is pulled to the outer sides of the first guide member and the second guide member. The technical feature that the turning member extends out of the base can increase the tension of the protective tape and facilitate cutting. By pressing the operation member, the operation member drives the linking member to actuate the blade holder so as to extend or retract the blade, thereby increasing the smoothness of operation. In addition, the guide plate is use to guide the base to quickly align with the edge of a product. The present invention has the advantages of complete protection and increased aesthetics, thereby achieving the purposes of labor-saving operation and easy force application.

DETAILED DESCRIPTION OF THE PREFERRED EMBODIMENTS

Embodiments of the present invention will now be described, by way of example only, with reference to the accompanying drawings.

Figure 1:
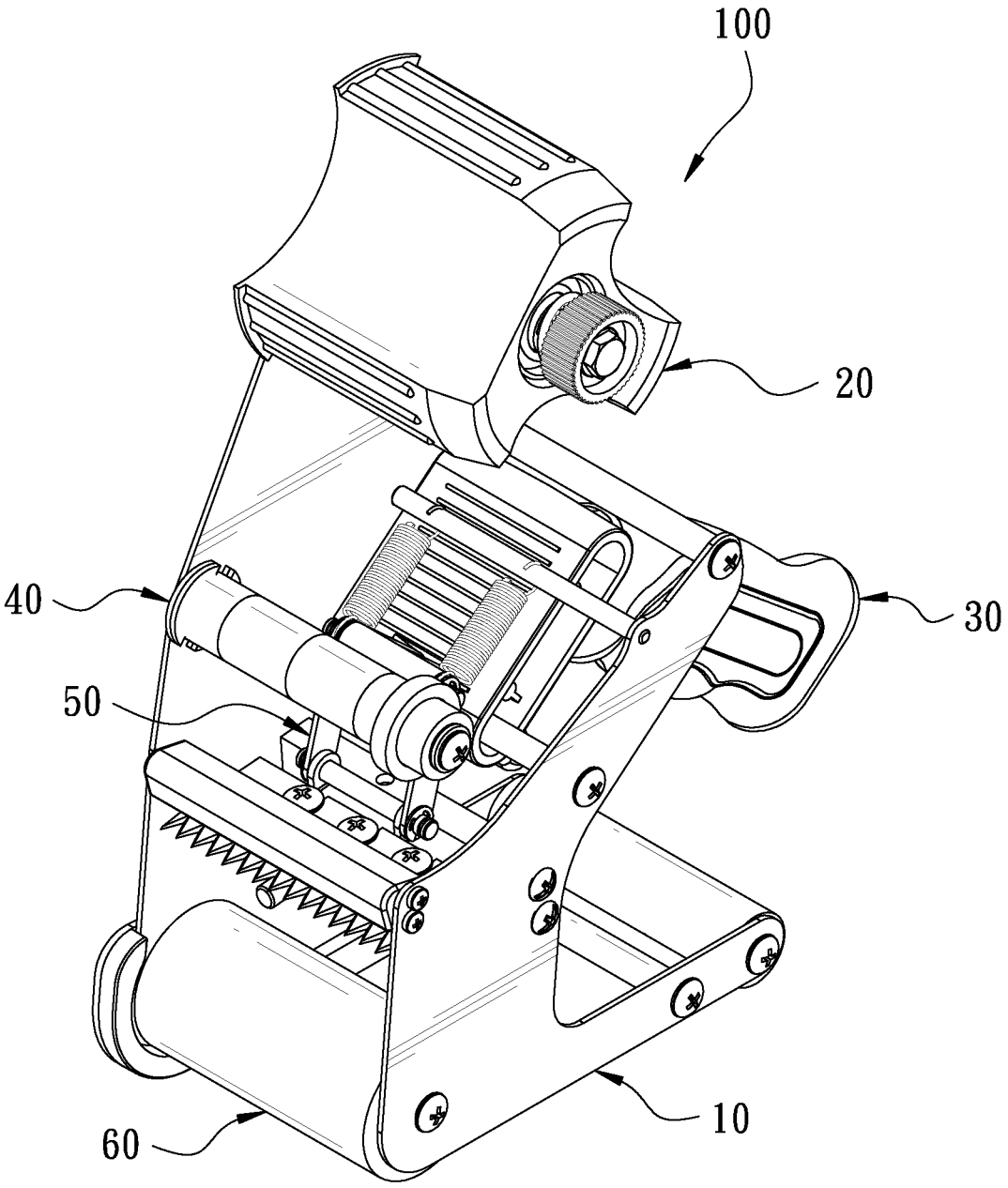
FIG. 1 is a perspective view in accordance with a preferred embodiment of the present invention.
Figure 2:
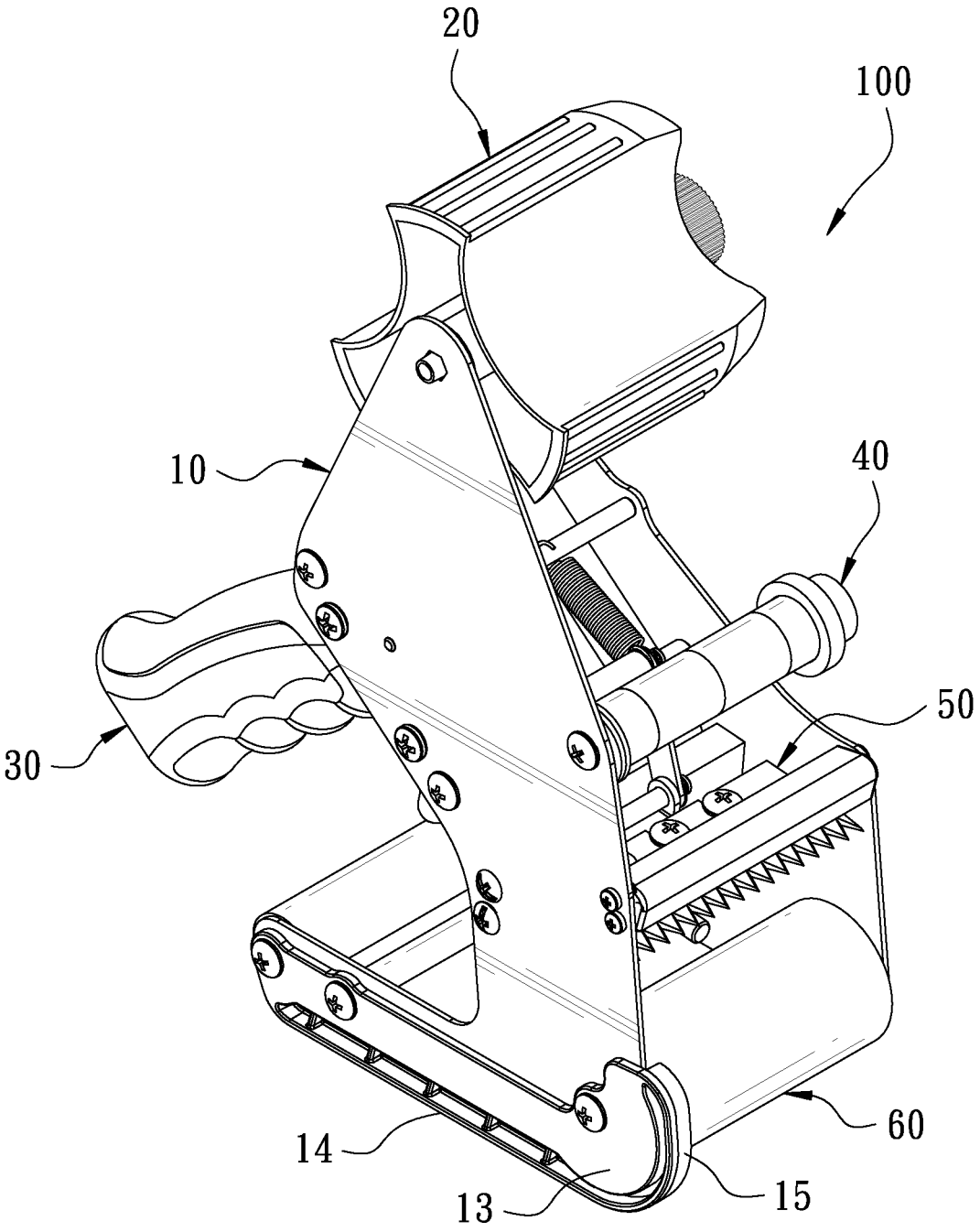
FIG. 2 is another perspective view in accordance with the preferred embodiment of the present invention.
Figure 3:
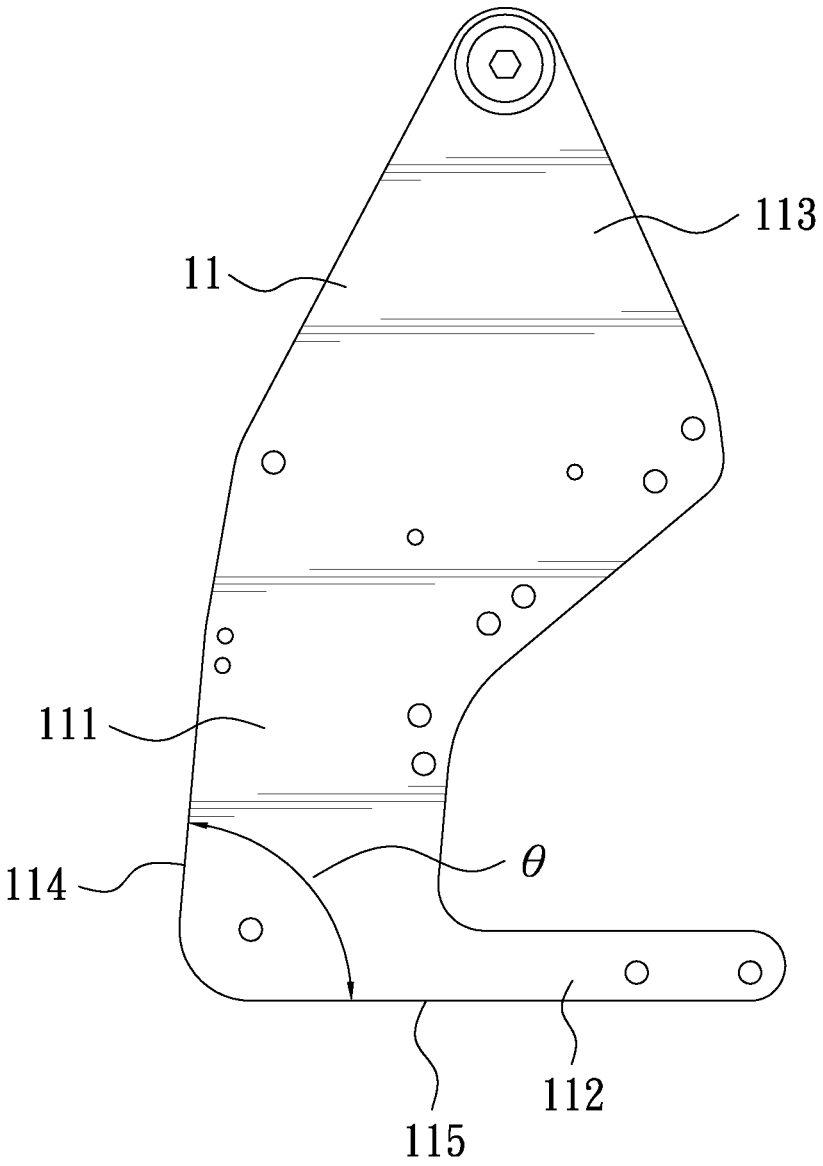
FIG. 3 is a side view of the first side plate in accordance with the preferred embodiment of the present invention.

FIG. 1 is a perspective view in accordance with a preferred embodiment of the present invention. FIG. 2 is another perspective view in accordance with the preferred embodiment of the present invention. FIG. 3 is a side view of a first side plate in accordance with the preferred embodiment of the present invention. The present invention discloses a protective tape dispenser 100. The protective tape dispenser 100 comprises a base 10, a mounting unit 20, a handle 30, a guide unit 40, a cutting unit 50, and a tape pressing unit 60.

The base 10 has a first side plate 11 and an opposing second side plate 12. In this embodiment of the present invention, the first side plate 11 and the second side plate 12 are generally a plate. The first side plate 11 and the second side plate 12 each include a middle portion 111, an abutting portion 112 at the bottom of the middle portion 111, and an extension portion 113 extending obliquely from the top of the middle portion 111. The shape of the extension portion 113 of the first side plate 11 is different from the shape of the extension portion of the second side plate 12. An angle θ is defined between a side edge 114 of the middle portion 111 and a bottom edge 115 of the abutting portion 112. The angle θ is less than 90 degrees. A guide plate 13 is connected to one side of the abutting portion 112 of the first side plate 11. A guide portion 14 extends outward from one side edge and a bottom edge of the guide plate 13. The guide portion 14 extends out of the first side plate 11. The guide portion 14 has a guide block 15. The thickness of the guide block 15 is greater than the thickness of the guide portion 14. The guide block 15 is located between the first side plate 11 and the second side plate 12. The guide block 15 is configured to guide the base 10 to be used aside, so as to align with a product.

The mounting unit 20 is pivotally connected to the extension portion 113 of the first side plate 11. The mounting unit 20 is configured to mount a protective tape roll 21.

Figure 4:
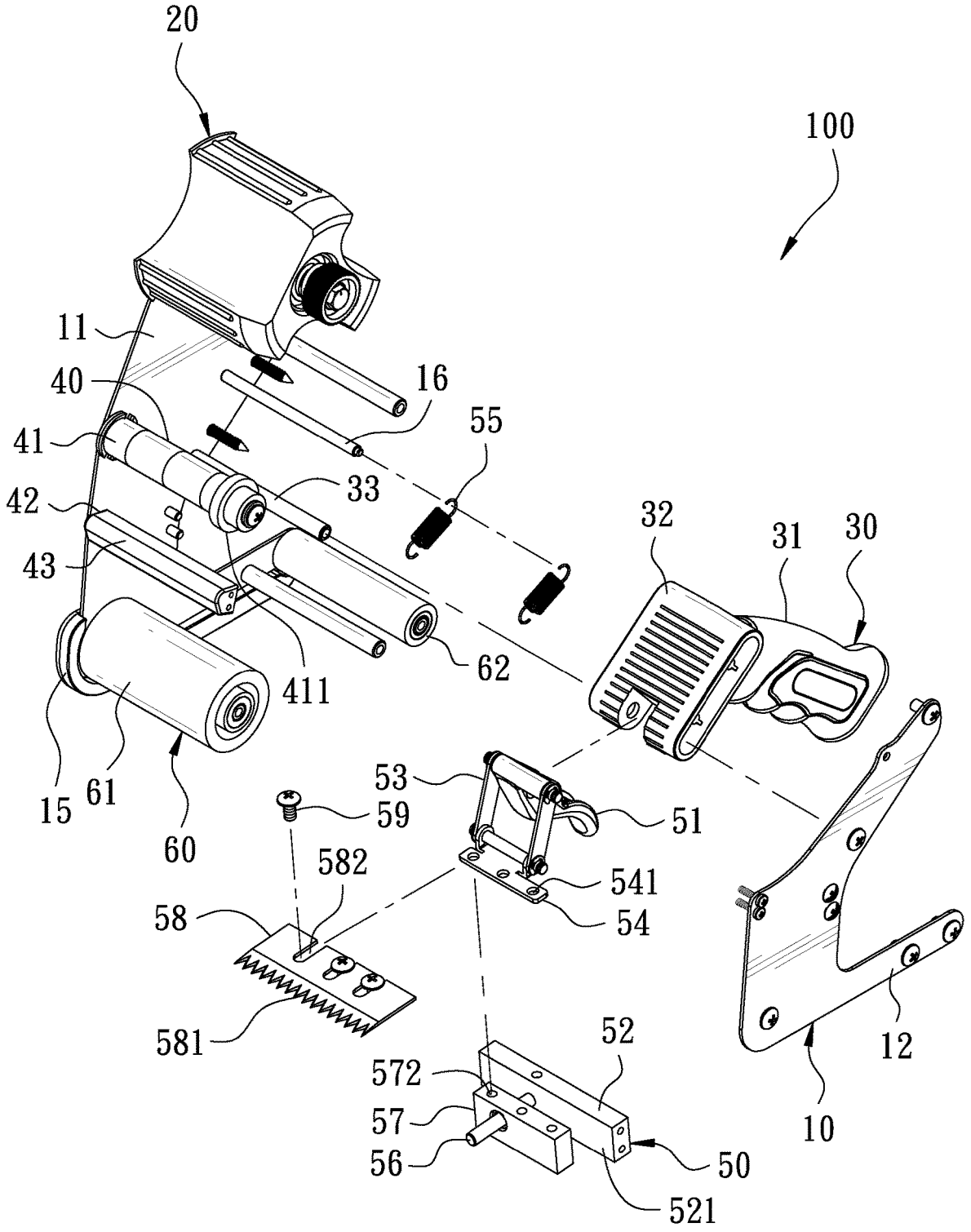
FIG. 4 is an exploded view in accordance with the preferred embodiment of the present invention.

The handle 30, referring to FIG. 4, is disposed between the extension portion 113 of the first side plate 11 and the extension portion of the second side plate 12, and is located under the mounting unit 20. The handle 30 has a holding portion 31 and a mounting portion 32. The mounting portion 32 is fixedly connected to the extension portion 113 of the first side plate 11. A pivot member 33 is inserted through the front end of the mounting portion 32. The pivot member 33 is a pivot shaft. The pivot member 33 is fixedly connected to the extension portion 113 of the first side plate 11 and the extension portion of the second side plate 12.

The guide unit 40 includes a tape pressing member 41 and a turning member 42. The tape pressing member 41 is rotatably, pivotally disposed on the extension portion 113 of the first side plate 11, and is located under the mounting unit 20. The tape pressing member 41 is sleeved with a stop ring 411. The stop ring 411 is movable and adjustable on the tape pressing member 41 according to the width of the protective tape roll 21. The turning member 42 is fixedly disposed between the middle portion 111 of the first side plate 11 and the middle portion of the second side plate 12, and is located under the tape pressing member 41. The turning member 42 is not cylindrical and cannot be rotated. The turning member 42 has a turning surface 43. The turning surface 43 extends out of the base 10. In this embodiment of the present invention, the turning surface 43 is a curved surface.

Figure 5:
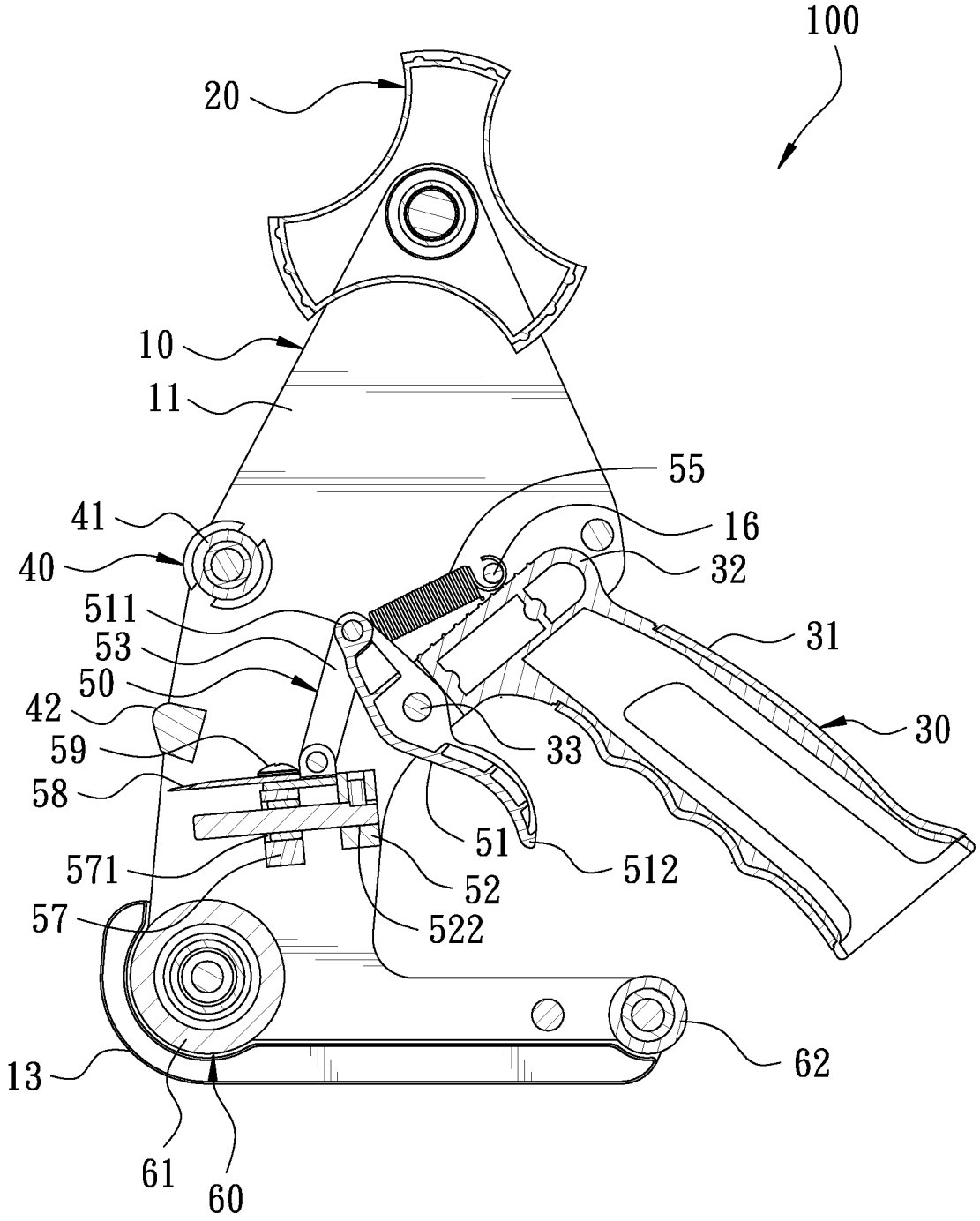
FIG. 5 is a cross-sectional view in accordance with the preferred embodiment of the present invention, wherein the blade is retracted inward.
Figure 6:
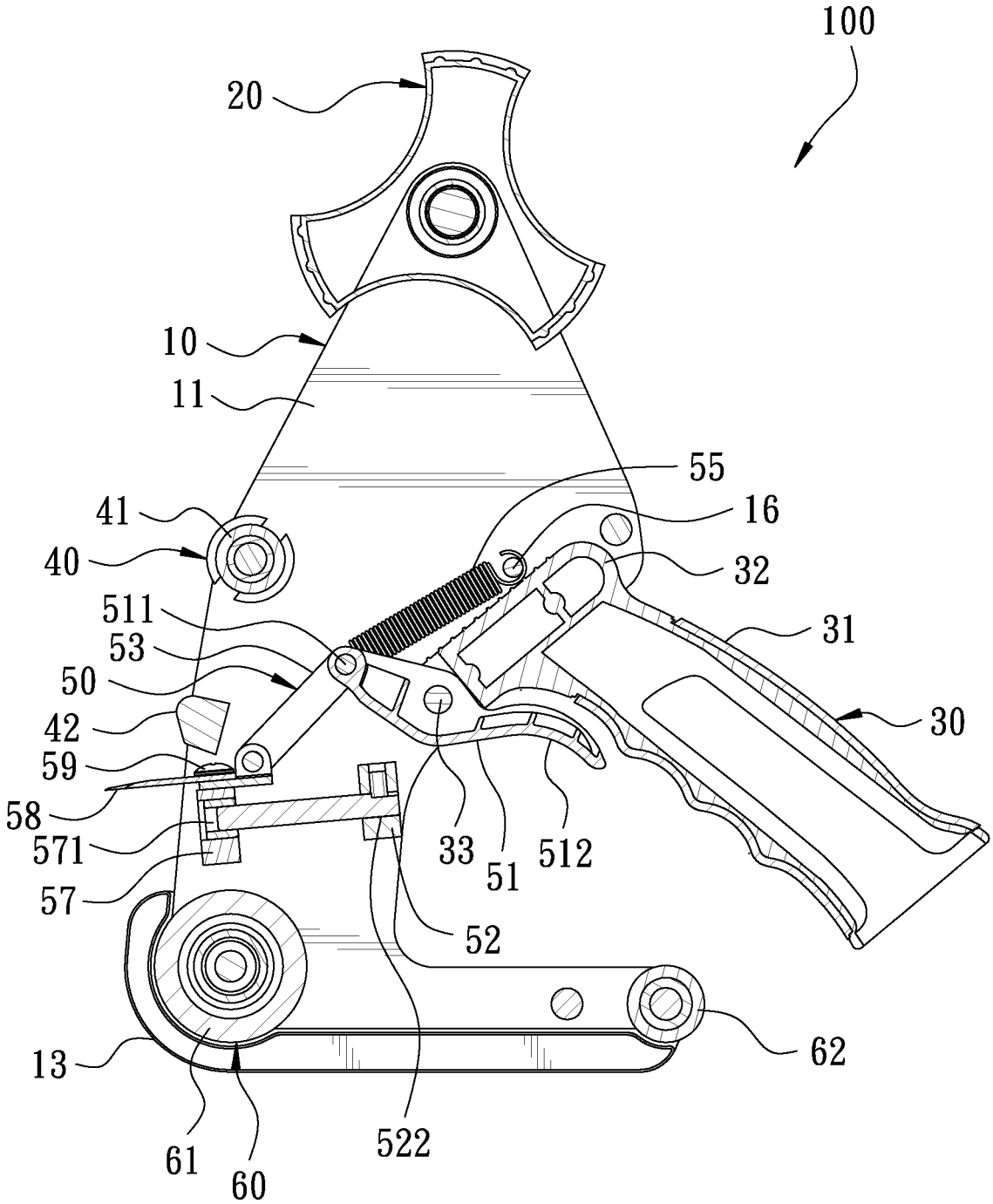
FIG. 6 is a cross-sectional view in accordance with the preferred embodiment of the present invention, wherein the blade is extended outward.

FIG. 5 and FIG. 6 are cross-sectional views in accordance with the preferred embodiment of the present invention. The cutting unit 50 includes an operation member 51 and a fixing seat 52. The operation member 51 is pivotally connected to the pivot member 33. The operation member 51 has a linking portion 511 and a pressing portion 512 that are located at two sides of the pivot member 33. In this embodiment of the present invention, the length of the linking portion 511 is less than the length of the pressing portion 512. The linking portion 511 is pivotally connected with a linking member 53. The linking member 53 is pivotally connected with a linking plate 54. The linking plate 54 has a plurality of perforations 541. A free end of the linking portion 511 is provided with a pair of elastic members 55. The other ends of the elastic members 55 are fixed to a fixed shaft 16 provided on the middle portion 111 of the first side plate 11. The elastic members 55 are springs. The fixing seat 52 is fixedly disposed between the first side plate 11 and the second side plate 12. The fixing seat 52 has a fixing surface 521. The fixing surface 521 is perpendicular to the linking plate 54 and can abut against the linking plate 54. The fixing surface 521 is provided with a through hole 522. A positioning member 56 is fixed to the through hole 522. The positioning member 56 is a shaft. The positioning member 56 is parallel to the linking plate 54. The positioning member 56 is connected with a blade holder 57. The fixing seat 52 and the blade holder 57 are spaced from each other. The blade holder 57 is provided with a transverse shaft hole 571. The positioning member 56 is inserted in the shaft hole 571, so that the blade holder 57 can move along the positioning member 56. The blade holder 57 is provided with a plurality of longitudinal fixing holes 572. A blade 58 is provided on the top of the blade holder 57. The blade 58 has a cutting edge 581 and a plurality of grooves 582. A plurality of fixing members 59 are inserted through the grooves 582, the perforations 541 and the fixing holes 572 for fixing the blade 58 to the blade holder 57, so that the blade 58, the linking plate 54 and the blade holder 57 can move along the positioning member 56.

The tape pressing unit 60 is pivotally connected to the abutting portion 112 of the first side plate 11 and the abutting portion of the second side plate 12. The tape pressing unit 60 has a first guide member 61 and a second guide member 62. The first guide member 61 is positioned at the turning point of the angle θ and is located under the blade holder 57, so that the blade holder 57 is located between the turning member 42 and the first guide member 61. The second guide member 62 is located under the handle 30. The guide block 15 is located at the outer edges of the first guide member 61 and the second guide member 62. In this embodiment of the present invention, the first guide member 61 and the second guide member 62 are rollers. The inner diameter of the first guide member 61 is greater than the inner diameter of the second guide member 62.

Figure 7:
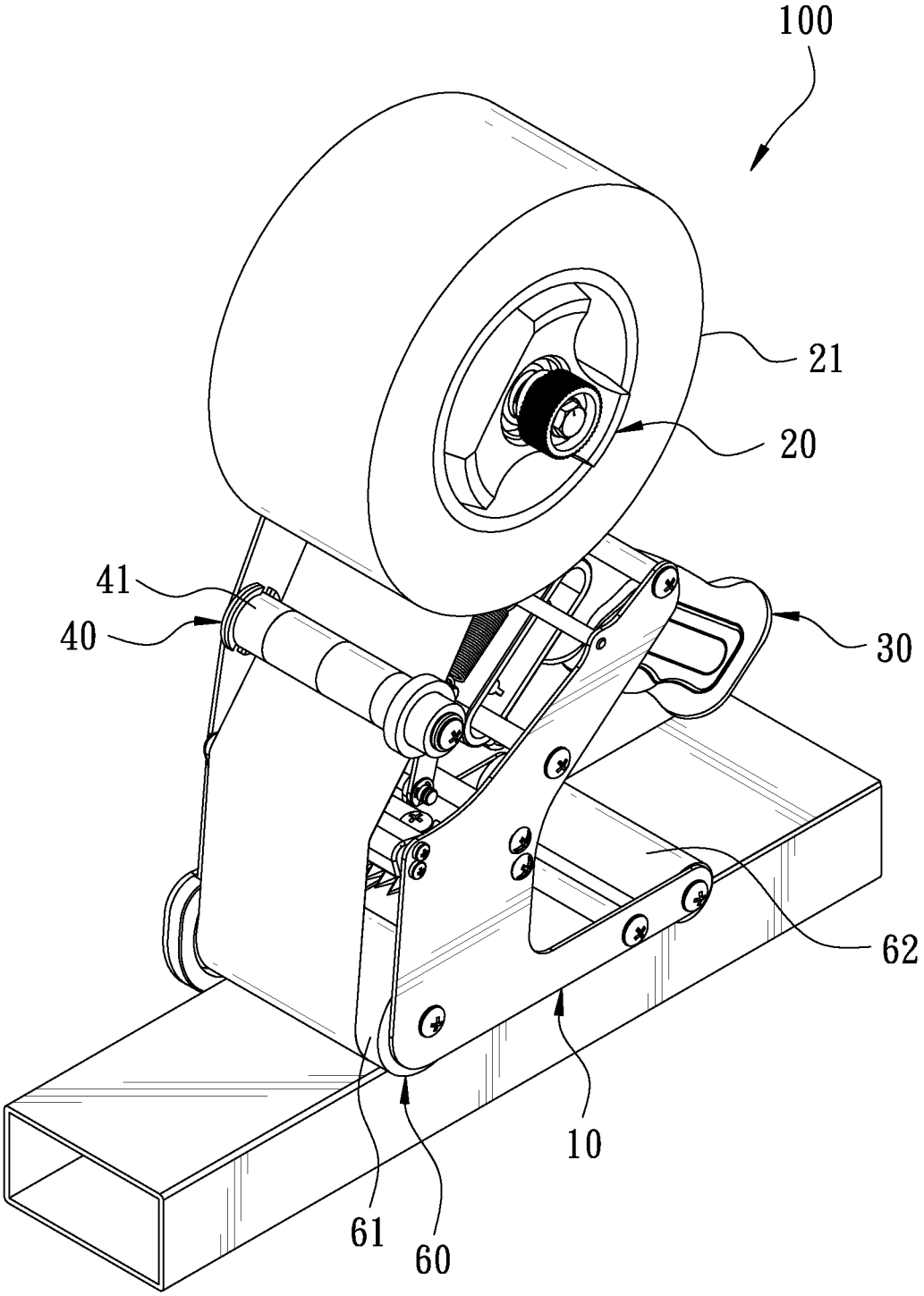
FIG. 7 is a schematic view in accordance with the preferred embodiment of the present invention when in use, showing that the packing strap is applied to attach to a product.
Figure 8:
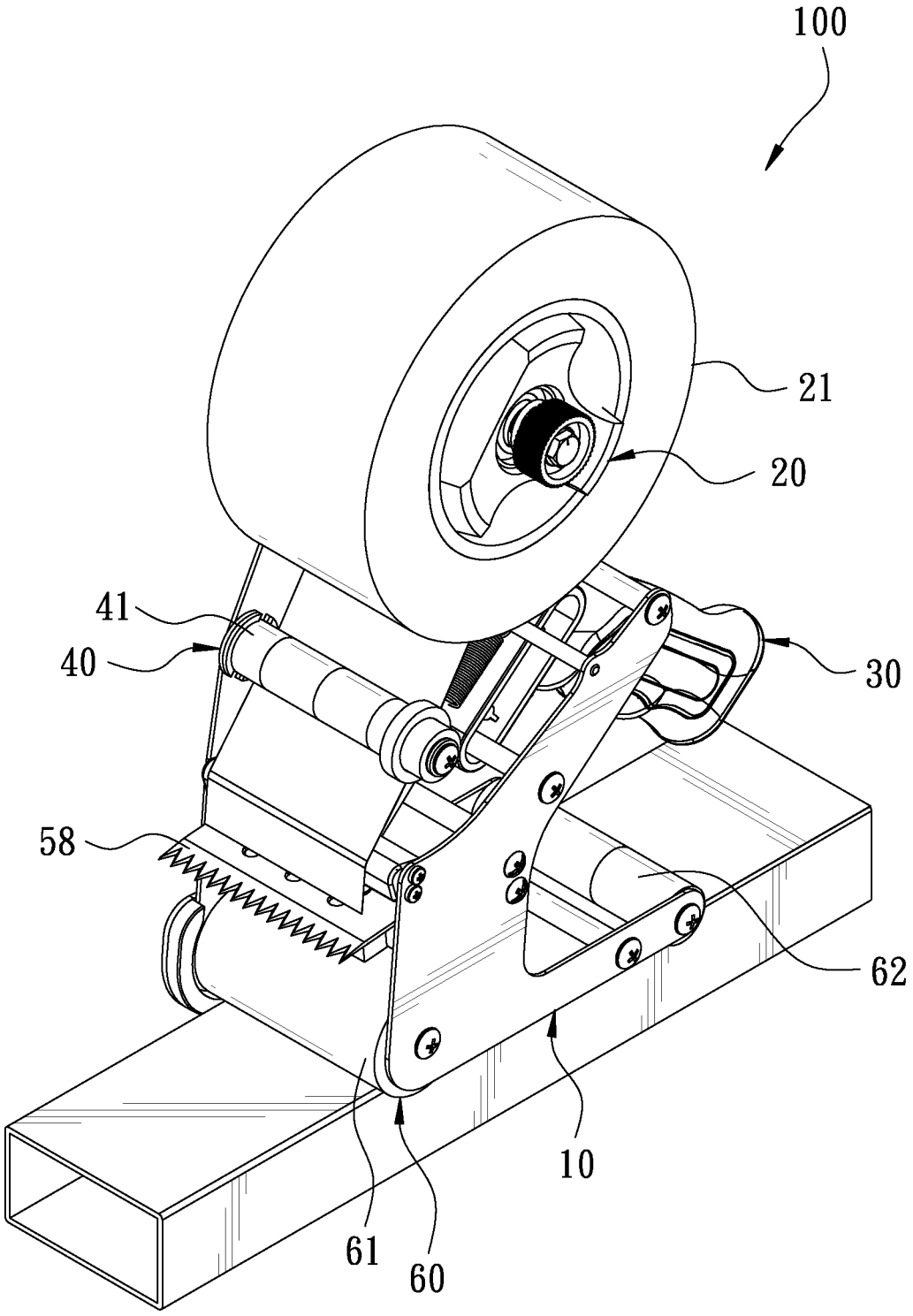
FIG. 8 is a schematic view in accordance with the preferred embodiment of the present invention when in use, showing that the packing strap is cut.

FIG. 7 and FIG. 8 are schematic views in accordance with the preferred embodiment of the present invention when in use. When the user wants to use the protective tape dispenser 100, the protective tape roll 21 is first mounted on the mounting unit 20, and then the protective tape of the protective tape roll 21 is pulled out to pass around the outer side of the turning member 42 along the inner side of the pressing member 41. The inner side is defined as facing the inside of the base 10, and the outer side is defined as facing the outside of the base 10. After that, the protective tape is pulled to the outer sides of the first guide member 61 and the second guide member 62. At this time, the user holds the protective tape dispenser 100 and applies the protective tape to attach to a product. Through the rotation of the first guide member 61 and the second guide member 62, the protective tape of the protective tape roll 21 is pulled out smoothly and attached to the product.

The user can move the stop ring 411 sleeved on the tape pressing member 41 to an appropriate position according to the width of the protective tape of the protective tape roll 21, so that the protective tape is confined between the first side plate 11 and the stop ring 411 to prevent the protective tape from deflecting in the process of adhering to the product. The bottom edge of the first side plate 11 is connected to the guide plate 13. The guide plate 13 can guide the base 10 to align with the product quickly.

When the user wants to use the blade 58 to cut the protective tape, the user only needs to press the pressing portion 512 of the operation member 51 to pivot the linking portion 511 of the operation member 51 about the pivot member 33. The linking member 53 is pivoted to drive the linking plate 54, so that the linking plate 54 can push the blade holder 57 and the blade 58 simultaneously, and the cutting edge 581 of the blade 58 extends out of the base 10. Because the turning member 42 extends out of the base 10, the protective tape passing through the tape pressing member 41 will change its angle, thereby turning and increasing the tension of the protective tape. In addition to increasing the flatness of the protective tape attached to the product, the cutting edge 581 of the blade 58 can cut the protective tape easily. At this time, the remaining protective tape of the protective tape roll 21 stays on the turning member 42 to facilitate the user to pull the protective tape next time. The elastic force of the elastic members 55 will pull back the linking portion 511 of the operation member 51 and simultaneously retract the linking member 53, the blade holder 57 and the blade 58 without interfering with the operation of the protective tape dispenser 100.

It is worth mentioning that the length of the linking portion 511 is less than the length of the pressing portion 512. When the cutting unit 50 is in a retracted state, an acute angle is maintained between the operation member 51 and the linking member 53, so that the user can press the pressing portion 512 for the blade 58 to extend quickly. When the cutting unit 50 is in an extended state, an obtuse angle is maintained between the operation member 51 and the linking member 53. Thereby, when the user releases the pressing portion 512, the blade 58 is quickly retracted through the elastic members 55, so that the operation is labor-saving and easy to apply force, so as to increase the smoothness of the operation.

The angle θ is defined between the side edge 114 of the middle portion 111 and the bottom edge 115 of the abutting portion 112 to maintain the uprightness of the protective tape dispenser 100 when in use. When the cutting unit 50 is operated, the blade 58 is kept a distance from the product without contacting the product, so as to maintain the appearance of the product.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A protective tape dispenser, comprising:

a base, having an abutting portion at a bottom thereof, the base having a pivot member;

a mounting unit, pivotally connected to the base, the mounting unit being configured to mount a protective tape roll;

a handle, disposed on the base;

a guide unit, disposed on the base, the guide unit including a tape pressing member and a turning member, the tape pressing member being located between the mounting unit and the turning member;

a cutting unit, disposed on the base, the cutting unit including an operation member and a fixing seat, the operation member being pivotally connected to the pivot member, the operation member having a linking portion and a pressing portion that are located at two sides of the pivot member, a free end of the linking portion being connected to one end of an elastic member, another end of the elastic member being fixed to the base, the fixing seat being fixed to the base, the fixing seat having a positioning member, the positioning member being connected with a blade holder, the blade holder being movable along the positioning member, the blade holder being provided with a blade;

a tape pressing unit, pivotally connected to the abutting portion, the tape pressing unit having a first guide member and a second guide member;

wherein the base has a first side plate and a second side plate, a guide plate is connected to a bottom of the first side plate, a guide portion extends outward from the guide plate, the guide portion has a guide block, and the guide block is located at outer edges of the first guide member and the second guide member.

2. The protective tape dispenser as claimed in claim 1, wherein the linking portion is pivotally connected with a linking member, the linking member is pivotally connected with a linking plate, the fixing seat has a fixing surface, the fixing surface is perpendicular to the linking plate and abuts against the linking plate, the positioning member is fixed to the fixing surface, the positioning member is parallel to the linking plate, the fixing seat and the blade holder are spaced from each other, and the blade holder is located between the turning member and the first guide member.

3. The protective tape dispenser as claimed in claim 2, wherein the linking plate has a plurality of perforations, the blade holder is provided with a plurality of fixing holes, the blade has a plurality of grooves, and a plurality of fixing members are inserted through the grooves, the perforations and the fixing holes for fixing the blade to the blade holder.

4. The protective tape dispenser as claimed in claim 1, wherein the blade holder is provided with a shaft hole, and the positioning member is insertedly disposed in the shaft hole.

5. The protective tape dispenser as claimed in claim 1, wherein the linking portion has a length less than that of the pressing portion.

6. The protective tape dispenser as claimed in claim 1, wherein the base has a side edge and a bottom edge, an angle is defined between the side edge and the bottom edge, and the angle is less than 90 degrees.

7. The protective tape dispenser as claimed in claim 1, wherein the first guide member and the second guide member are rollers, and the first guide member has an inner diameter greater than that of the second guide member.

8. The protective tape dispenser as claimed in claim 1, wherein the tape pressing member is sleeved with a stop ring.

9. The protective tape dispenser as claimed in claim 1, wherein the tape pressing member is located between the mounting unit and the turning member, the turning member is not rotatable, the turning member has a turning surface, and the turning surface extends out of the base.

* * * * *